US006860630B2

(12) United States Patent
Wu

(10) Patent No.: US 6,860,630 B2
(45) Date of Patent: Mar. 1, 2005

(54) LAMP ASSEMBLY DEVICE WITH DETACHABLE LAMP ROD

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/402,792

(22) Filed: Mar. 27, 2003

(65) Prior Publication Data

US 2004/0190300 A1 Sep. 30, 2004

(51) Int. Cl.[7] ..... F21V 17/00

(52) U.S. Cl. ..... 362/581; 362/365; 362/402; 362/457; 439/358; 174/57; 174/65 R

(58) Field of Search ..... 362/364, 365, 362/402, 418, 455, 457, 581; 248/342, 343; 439/357, 358; 174/52.1, 53, 54, 57, 60, 61, 65 R

(56) References Cited

U.S. PATENT DOCUMENTS 6,489,560 B1 * 12/2002 Wu ..... 174/65 R 6,617,513 B1 * 9/2003 Wu ..... 174/65 R

* cited by examiner

*Primary Examiner*—John Anthony Ward

(57) ABSTRACT

A lamp assembly device with a detachable lamp rod is disclosed. A lateral side of the wire winding box has a via hole. An end surface of the lamp seat has a recess and near a front edge of the lamp seat is installed with a groove. A recess is communicable to the groove. A free end of the elastic piece is locked into the groove so as to buckle with the lamp rod. A front end of the lamp rod is installed with an end portion which exactly inserts into the inserting seat. A block of the lamp rod exactly passes through the recess. An end portion of the lamp rod inserts into the inserting seat so that the lamp seat is conductive to the lamp rod. Thereby the lamp rod and lamp rod are detachable so as to reduce the volume in transfer and storage.

2 Claims, 5 Drawing Sheets

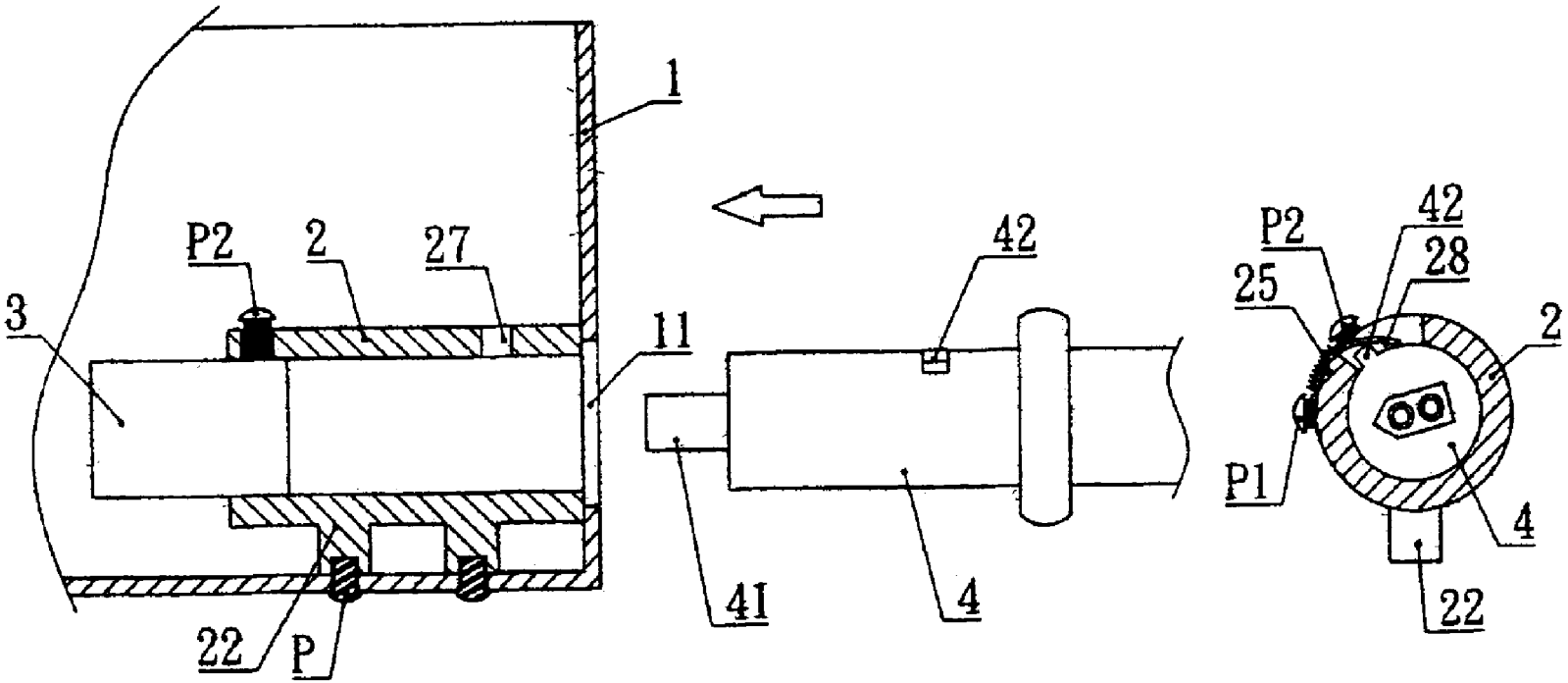
Fig 3-A

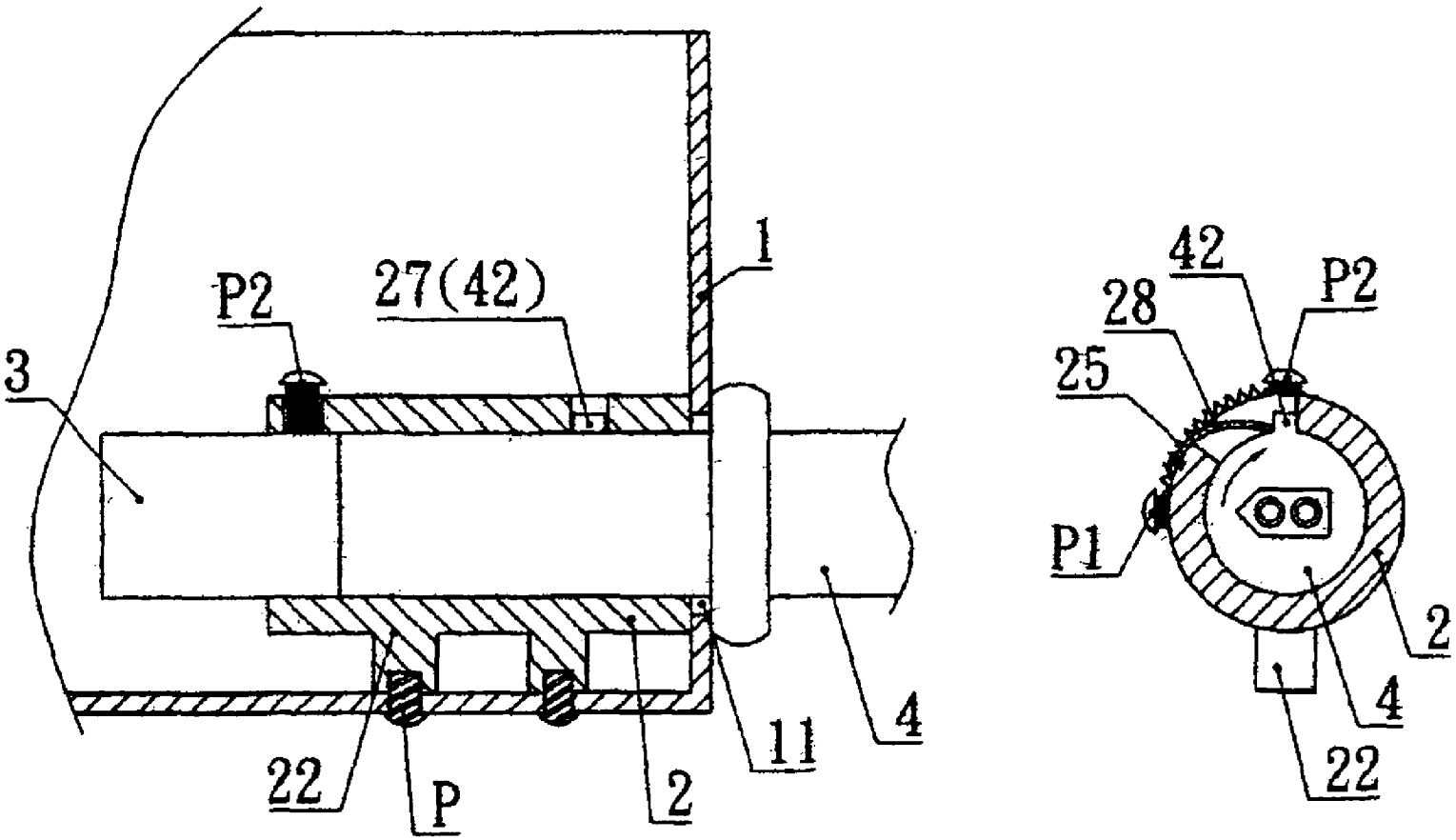
Fig. 3-B

LAMP ASSEMBLY DEVICE WITH DETACHABLE LAMP ROD

BACKGROUND OF THE INVENTION

The present invention relates to lamp assembly devices, and particularly to a tamp assembly device with a detachable lamp rod. By the design of the present invention, a user can assemble the lamp rod by inserting it into the lamp seat easily; thus, the lamp is detachable for storage and transfer with a smaller volume.

The prior art buckling structures of lamps, such as wall lamps, seat lamps, or stand lamps, are assembled by screwing studs with nuts. Not only collision accident easy occurs, but also the locking tools (for example, spanners, openers, etc.) are necessarily used in assembly. In assembly, the wires will expose so as to generate electric shock. Moreover, the assembly work is tedious and thus it is unsuitable for being assembled by the users themselves. Thus generally, the wire winding box is assembled with the inserting rod before sale. Thereby, the cost is high and a larger space is necessary for transfer and storage.

SUMMARY OF THE INVENTION

Accordingly, the primary object of the present invention, is to provide a lamp assembly device with a detachable lamp rod which comprises a lamp seat firmly secured to a lateral side of a wire winding box, and a lamp rod inserted into the lamp seat. A lateral side of the wire winding box has a via hole. An end surface of the lamp seat has a recess and near a front edge of an outer surface of the lamp seat is installed with a groove. The recess is communicable to the groove. A free end of the elastic piece is locked into the groove so as to buckle the lamp rod. A front end of the lamp rod is installed with an end portion which exactly inserts into the inserting seat. A portion of the lamp rod is protruded with a block. The block exactly passes through the recess; The end portion of the lamp rod inserts into the inserting seat so that the lamp seat is conductive to the lamp rod. Thereby the lamp rod and lamp seat are detachable so as to reduce the volume for transfer and storage.

The various objects and advantages of the present invention will be more readily understood from the following detailed description when read in conjunction with the appended drawing.

BRIEF DESCRIPTION OF THE DRAWINGS

FIG. 3A shows one embodiment before the insertion of the lamp rod.

FIG. 3B shows one embodiment after the insertion of the lamp rod.

BRIEF DESCRIPTION OF THE PREFERRED EMBODIMENTS

Figure 1:
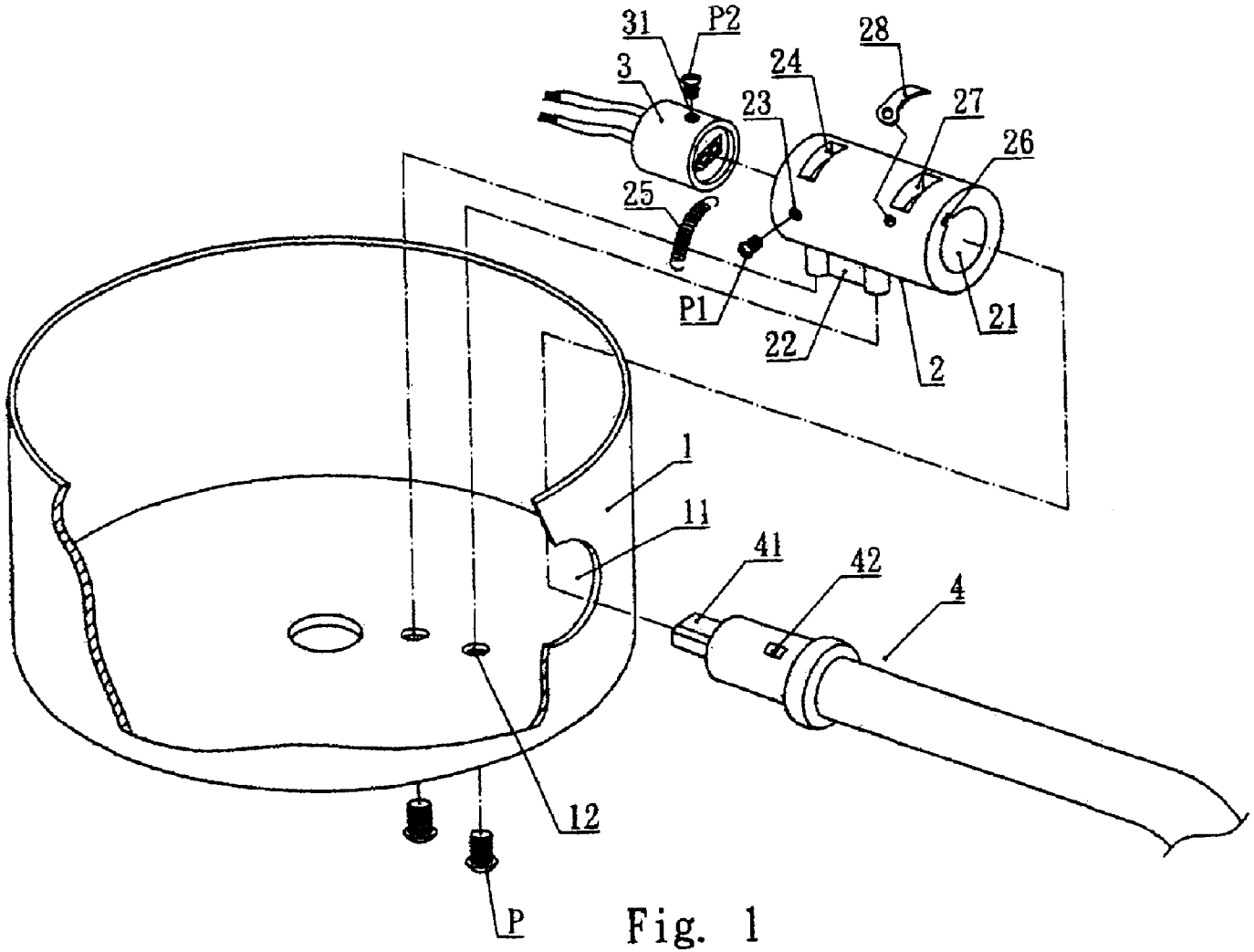
FIG. 1 is an exploded perspective view of the present invention.
Figure 2:
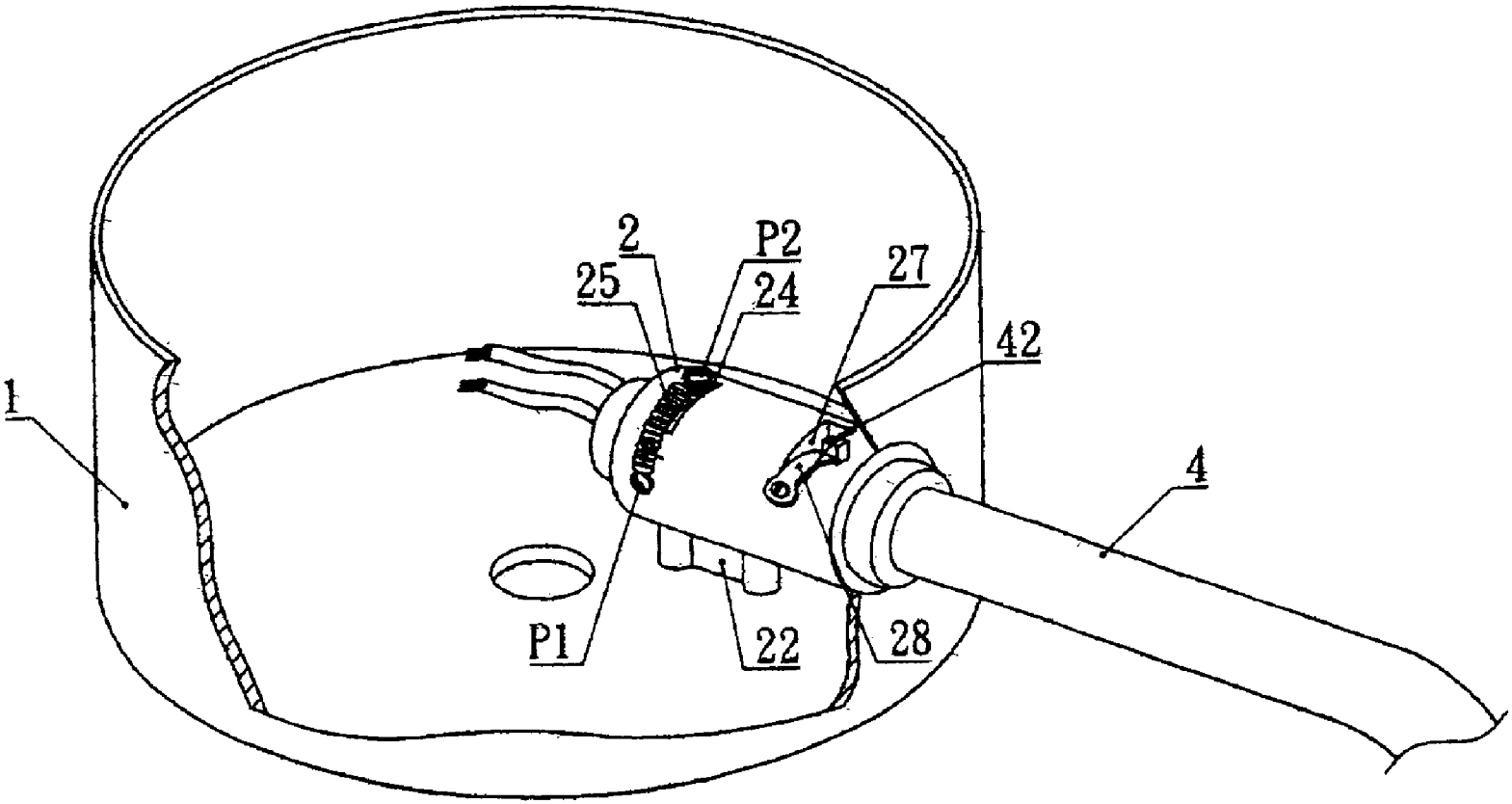
FIG. 2 is an assembled perspective view of the present invention.

Referring to FIGS. 1 and 2, the lamp with a detachable lamp rod and a retaining seat of the present invention is illustrated. The locking device includes a lamp seat 2 firmly secured to a lateral side of a wire winding box 1, and a lamp rod 4 inserted into the lamp seat 2.

A lateral side of the wire winding box 1 has a via hole 11 and a bottom of the wire winding box 1 coupled to the lamp seat 2 has a through hole 12 for being passed by a stud P so as to lock the lamp seat 2 to a predetermined position.

A portion of the lamp seat 2 coupled to the via hole 11 of the wire winding box 1 has a penetrating hole 21 and a bottom of the lamp seat 2 protrudes with a locking seat 22 with a configuration corresponding to the through hole 12 of the wire winding box 1, thereby the stud P can pass through the through hole 12 from a lower end of the wire winding box 1 and then is locked to the locking seat 22 so as to fix the lamp seat 2 to the wire winding box 1. A distal end of the lamp seat 2 is formed with a screw hole 23. An annular slot 24 is formed along a surface of the lamp seat 2. Thereby, two ends of a tension spring 25 are locked between the screw hole 23 and the annular slot 24 by using studs P1 and P2, respectively. An end surface of the lamp seat 2 has ha recess 26 and near a front edge of an outer surface of the lamp seat 2 is installed with a groove 27. The recess 26 is communicable to the groove 27. An elastic piece 28 is locked aside the groove 27. A free end of the elastic piece 28 is locked into the groove 27 so as to buckle the lamp rod 4.

A distal end of the lamp seat 2 is locked with an inserting seat 3 which is exactly resisted by the end portion 41 of the lamp rod 4. A portion of the inserting seat 3 coupled to the annular slot 24 has a positioning screw hole 31. Thereby, one end of the tension spring 25 is screwed to the screw hole 34 by the stud P1 and another end of the tension spring 25 passes through the annular slot 24 by the stud P2 so as to be locked in the screw hole 31 of the inserting seat 3. Thereby, the end of the tension spring 34 fixed to the inserting seat 3 can rotate with the inserting seat 3.

A front end of the lamp rod 4 is installed with an end portion 41 which exactly inserts into the inserting seat 3. A portion Of the lamp rod 4 coupled to, the recess 26 of the lamp seat 2 is protruded with a block 42. The block exactly passes through the recess 26 to be buckled in the groove 27. At the same time, the end portion 41 of the lamp rod 4 inserts into the inserting seat 3 so that the lamp seat 2 is conductive to the lamp rod 4.

Referring to FIG. 3, the block 42 of the lamp rod 4 is coupled to the recess 26 of the lamp seat 2. Thereby, the lamp rod 4 is inserted until the block 42 is engaged to the groove 27 of the lamp rod 4. The end portion 41 of the lamp rod 4 exactly inserts into the inserting seat 3 (referring to FIG. 3A). Then the lamp rod 4 rotates through an angle so that the block of the lamp rod 4 is exactly buckled to the elastic piece 28 in the slot 27. Furthermore, since the rotation of the lamp rod 4 will drive the inserting seat 3 to rotate synchronously. As a result, the inserting seat 3 will pull the tension spring 25 at the same time so as to limit the lamp rod 4 substantially (referring to FIG. 3B).

Figure 4:
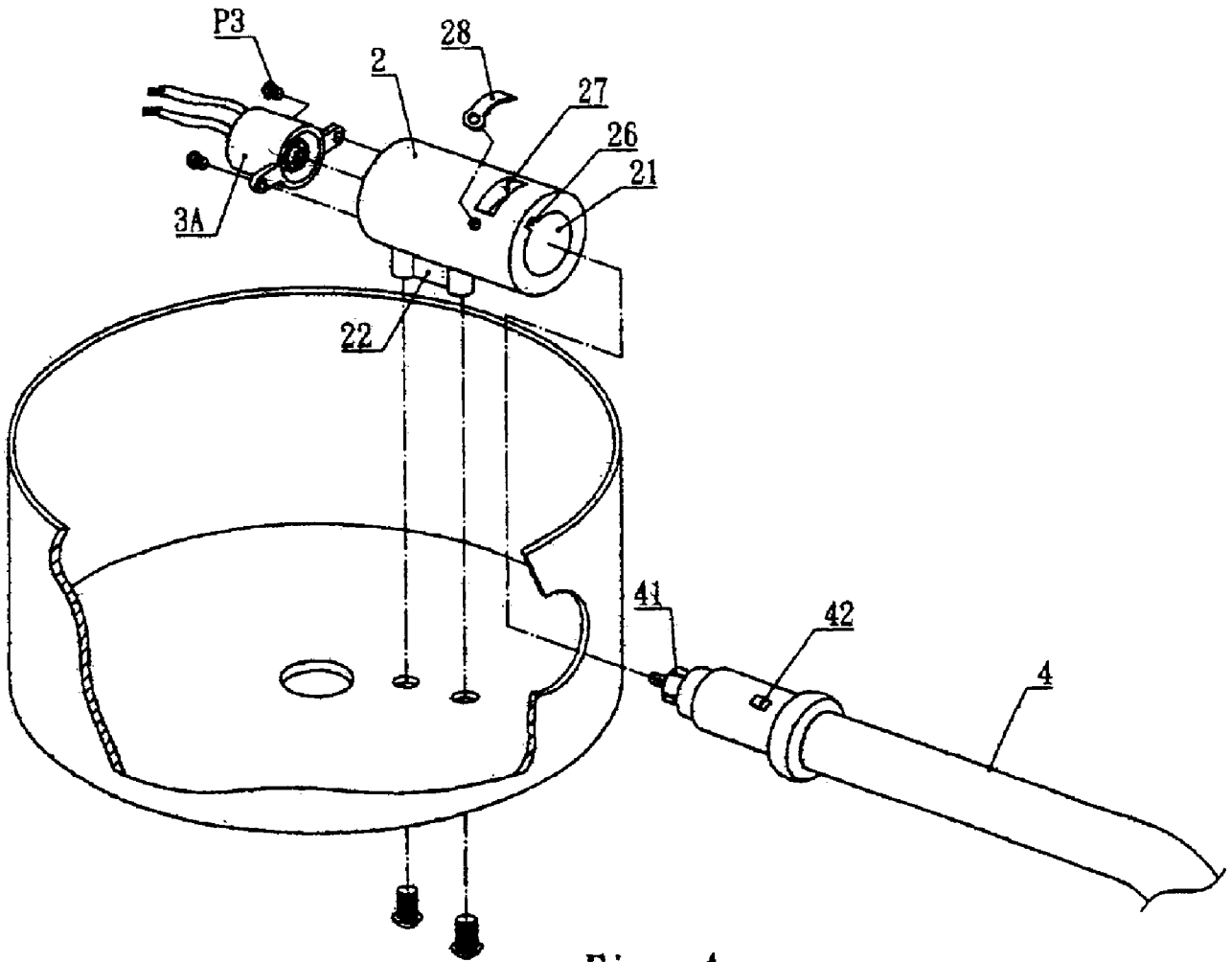
FIG. 4 is an exploded perspective view of another embodiment of the present invention.

With reference to FIG. 4, another embodiment of the present invention is illustrated. A front end of the lamp seat 2 has a recess 26 and a groove 27. A distal end of the lamp seat 2 is locket to the inserting seat 3A by a screw P3. When the lamp rod 4 inserts into the lamp seat 2, the end portion 41 of the lamp rod 4 exactly inserts into the inserting seat 3A. Then the lamp rod 4 rotates through an angle so that the block 42 of the lamp rod 4 is exactly buckled to the elastic piece 28 which protrudes into the groove 27 so as to limit the lamp rod 4 substantially.

By above said structure, in transferring or storage, the lamp rod 4 and the wire winding box 1 can be detached in advance so as to reduce the volume. In use, the user only needs to insert the lamp rod 4 into the lamp seat 2 without using any locking tools. Thus, the user can assemble the lamp by himself (or herself).

The present invention is thus described, it will be obvious that the same may be varied in many ways. Such variations are not to be regarded as a departure from the spirit and scope of the present invention, and all such modifications as, would be obvious to one skilled in the art are intended to be included within the scope of the following claims.

What is claimed is:

1. A lamp assembly device with a detachable lamp rod comprising a lamp seat firmly secured to a lateral side of a wire winding box, and a lamp rod inserted into the lamp seat; wherein a lateral side of the wire winding box has a via hole; a bottom of the lamp seat protrudes with a locking seat; an end surface of the lamp seat has a recess and near a front edge of an outer surface of the lamp seat is installed with a groove; the recess is communicable to the groove; an elastic piece is locked aside the groove; a free end of the elastic piece is locked into the groove so as to buckle the lamp rod;

a front end of the lamp rod is installed with an end portion which exactly inserts into an inserting seat; a portion of the lamp rod coupled to the recess of the lamp seat is protruded with a block; the block exactly passes through the recess to be buckled in the groove; further, the end portion of the lamp rod inserts into the inserting seat so that the lamp seat is conductive to the lamp rod;

thereby the lamp rod and lamp seat are detachable so as to reduce the volume in transfer and storage; and wherein a portion of the lamp seat coupled to the via hole of the wire winding box has a penetrating hole and a bottom of the lamp seat protrudes with a locking seat having a configuration corresponding to the through hole of the wire winding box, then a stud passes through the through hole from a lower end of the wire winding box and then is locked to the locking seat so as to fix the lamp seat to the wire winding box.

2. A lamp assembly device with a detachable lamp rod comprising a lamp seat firmly secured to a lateral side of a wire winding box, and a lamp rod inserted into the lamp seat; wherein a lateral side of the wire winding box has a via hole; a bottom of the lamp seat protrudes with a locking seat; an end surface of the lamp seat has a recess and near a front edge of an outer surface of the lamp seat is installed with a groove; the recess is communicable to the groove; an elastic piece is locked aside the groove; a free end of the elastic piece is locked into the groove so as to buckle the lamp rod;

a front end of the lamp rod is installed with an end portion which exactly inserts into an inserting seat; a portion of the lamp rod coupled to the recess of the lamp seat is protruded with a block; the block exactly passes through the recess to be buckled in the groove; further, the end portion of the lamp rod inserts into the inserting seat so that the lamp seat is conductive to the lamp rod;

thereby the lamp rod and lamp seat are detachable so as to reduce the volume in transfer and storage; and wherein a distal end of the lamp seat is locked with the inserting seat which is exactly resisted by the end portion of the lamp rod; a portion of the inserting seat coupled to the annular slot has a positioning screw hole; thereby, one end of the tension spring is screwed to the screw hole by a stud and another end of the tension spring passes through the annular slot by another stud so as to be locked in the screw hole of the inserting seat; thereby, the end of the tension spring fixed to the inserting seat rotates with the inserting seat.

* * * * *